US009915030B2

(12) United States Patent
Henry et al.

(10) Patent No.: US 9,915,030 B2
(45) Date of Patent: Mar. 13, 2018

(54) WASHING APPARATUS AND METHOD FOR PREPARATION OF CELLULOSE FIBERS FOR USE IN MANUFACTURE OF BIOCOMPOSITE MATERIALS

(71) Applicant: CNH Industrial Canada, Ltd., Saskatoon (CA)

(72) Inventors: James Henry, Saskatoon (CN); Satyanarayan Panigrahi, Saskatoon (CA); Radhey Lal Kushwaha, Saskatoon (CA)

(73) Assignee: CNH Industrial Canada, Ltd., Saskatoon, Saskatchewan (CA)

( * ) Notice: Subject to any disclaimer, the term of this patent is extended or adjusted under 35 U.S.C. 154(b) by 168 days.

(21) Appl. No.: 14/662,879

(22) Filed: Mar. 19, 2015

(65) Prior Publication Data

US 2015/0267342 A1 Sep. 24, 2015

Related U.S. Application Data

(60) Provisional application No. 61/955,429, filed on Mar. 19, 2014.

(51) Int. Cl.
*D21C 7/12* (2006.01)
*D21C 7/14* (2006.01)
(Continued)

(52) U.S. Cl.
CPC ..... *D21C 9/06* (2013.01); *D06L 1/12* (2013.01); *D21C 7/12* (2013.01); *D21C 7/14* (2013.01);
(Continued)

(58) Field of Classification Search
CPC ..... D21C 7/00–7/14
(Continued)

(56) References Cited

U.S. PATENT DOCUMENTS 2,090,925 A 8/1937 Wilkinson et al.
2,957,209 A 4/1942 Kerr
(Continued)

FOREIGN PATENT DOCUMENTS

EP 0220913 5/1987
GB 266168 2/1927
(Continued)

OTHER PUBLICATIONS

Phillips Mark, Heating in Agitated and Non-Agitated Vessels, Jan. 2014, IBD/BFBi Midland Section Engineering Symposium on Heat Transfer and Refigeration.*
(Continued)

*Primary Examiner* — Anthony Calandra
(74) *Attorney, Agent, or Firm* — Rebecca L. Henkel; Rickard K. DeMille

(57) ABSTRACT

According to one aspect of the present disclosure, a mechanism and method is provided to clean and remove or separate cellulose fibers from the source fibrous material without stressing and/or damaging the cellulose fibers. The mechanism includes an agitator that directs the washing fluid in a vertical direction into engagement with the fibrous material to effect maximum cleaning of the cellulose from the remainder of the fibrous material without damaging or stressing the cellulose, thereby providing cellulose that can enhance the strength and other beneficial characteristics of a biocomposite material formed using the cellulose.

18 Claims, 3 Drawing Sheets

(51) Int. Cl.

| | |
|---|---|
| ***D21C 9/06*** | (2006.01) |
| ***D06L 1/12*** | (2006.01) |
| ***D21C 9/00*** | (2006.01) |
| ***D21C 9/10*** | (2006.01) |

(52) U.S. Cl.
CPC ..... *D21C 9/005* (2013.01); *D21C 9/007* (2013.01); *D21C 9/10* (2013.01); *D10B 2201/01* (2013.01)

(58) Field of Classification Search
USPC ..... 162/233–251
See application file for complete search history.

(56) References Cited

U.S. PATENT DOCUMENTS

| | | | | |
|---|---|---|---|---|
| 2,708,160 | A | 5/1955 | Aronovsky et al. | |
| 3,298,900 | A * | 1/1967 | Laakso | D21C 9/10 162/17 |
| 5,788,812 | A | 8/1998 | Agar et al. | |
| 6,302,997 | B1 | 10/2001 | Hurter et al. | |
| 6,372,086 | B1 | 4/2002 | Sueron et al. | |
| 7,061,597 | B2 | 6/2006 | Oberfeitner et al. | |
| 7,186,316 | B1 | 3/2007 | Ryu et al. | |
| 7,892,397 | B2 | 2/2011 | Luo et al. | |
| 2006/0128952 | A1 | 6/2006 | Schroder | |
| 2010/0329943 | A1 * | 12/2010 | Kallmes | D21C 7/14 422/187 |
| 2013/0040354 | A1 | 2/2013 | Olsen | |
| 2013/0210102 | A1 | 8/2013 | Slupska et al. | |

FOREIGN PATENT DOCUMENTS

| | | |
|---|---|---|
| WO | 2010147118 | 12/2010 |
| WO | 2013044347 | 4/2013 |

OTHER PUBLICATIONS

PCT/IB2015/000375, International Search Report and Written Opinion, dated Jul. 10, 2015, 7 pages.
http://www.utahbiodieselsupply.com/washingsupplies.php, 17 pages, Mar. 18, 2015.
Akin et al., "Pilot plant for processing flax fiber", Industrial Crops and Pioducts 21 (2005) 369-378.

* cited by examiner

WASHING APPARATUS AND METHOD FOR PREPARATION OF CELLULOSE FIBERS FOR USE IN MANUFACTURE OF BIOCOMPOSITE MATERIALS

CROSS-REFERENCE TO RELATED APPLICATIONS

This application claims priority from U.S. Provisional Patent Application Ser. No. 61/955,429, filed on Mar. 19, 2014, the entirety of which is expressly incorporated by reference herein.

FIELD OF THE INVENTION

The subject matter disclosed herein relates generally to biocomposite materials and, in particular, to a method and system for the preparation of cellulose fibers from raw cellulosic fibrous materials for use in the manufacture of biocomposite materials.

BACKGROUND OF THE INVENTION

Fibrous materials such as straw from flax, sisal, hemp, jute and coir, banana among others, consist of four main compounds: cellulose, hemicellulose, lignin, and impurities (e.g., dirt, dust). When these fibrous materials are used in the formation of biocomposite materials, it is the cellulose component of the fibrous material that contains and provides the strength and structural properties that are desired, while the hemicellulose, lignin, and the impurities have no real value for the biocomposite material in terms of properties or performance enhancements. As a result, these components of the fibrous material are removed prior to use in the formation of biocomposite materials.

One method in which the cellulose is removed from the remainder of the fraction is by pretreatment and washing the fibrous material. Current washing practices are able to remove the maximum amount of hemicellulose and impurities from the fibrous materials. However, these washing techniques have problems removing the lignin from the fibers, which necessitates additional processing of the fibers in order to remove the lignin, which is undesirable for use in the formulation of biocomposite materials for various reasons.

As a result, it is desirable to develop a mechanism and method that can overcome the deficiencies of prior art washing methods to remove the maximum amount of unwanted compounds from fibrous materials, e.g., the hemicellulose and lignin fractions along with the impurities that may be present, while leaving the cellulose undamaged to maximize the benefits provided to the biocomposite material including the cellulose. In particular, such a mechanism will maximize the strength characteristics of the fiber by leaving the cellulose fraction undamaged. The mechanism must additionally be formed of materials that are resistant to corrosion (i.e. plastic, stainless steel), as the washing agents utilized in the method can be corrosive.

SUMMARY OF THE INVENTION

According to one aspect of an exemplary embodiment of the present disclosure, a mechanism and method is provided to clean and separate cellulose fibers from the source fibrous material without stressing and/or damaging the cellulose fibers. The separation of the cellulose fibers from the hemicelluloses, lignin and impurities in the disclosed mechanism and method allows for the optimization/close control of the washing environment, and the recycling of the washing agents to reduce consumption of water and the chemical washing agents used therein, thereby reducing waste and cost for the preparation of the cellulose fibers.

According to another aspect of an exemplary embodiment of the present disclosure, the washing of the fibrous material in the disclosed mechanism and method also maintains the desired cellulose material in an undamaged condition, thus maintaining the beneficial strength characteristics of the fibrous material/cellulose fibers for use in forming the biocomposites.

According to another aspect of an exemplary embodiment of the present disclosure, the manual labor necessary for the washing of the fibrous material is also reduced significantly, and the mechanism is easily scalable to accommodate larger or smaller amounts of the fibrous material to be washed to obtain the cellulose fibers for use in forming biocomposites.

These and other objects, advantages, and features of the invention will become apparent to those skilled in the art from the detailed description and the accompanying drawings. It should be understood, however, that the detailed description and accompanying drawings, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE INVENTION

Figure 1:
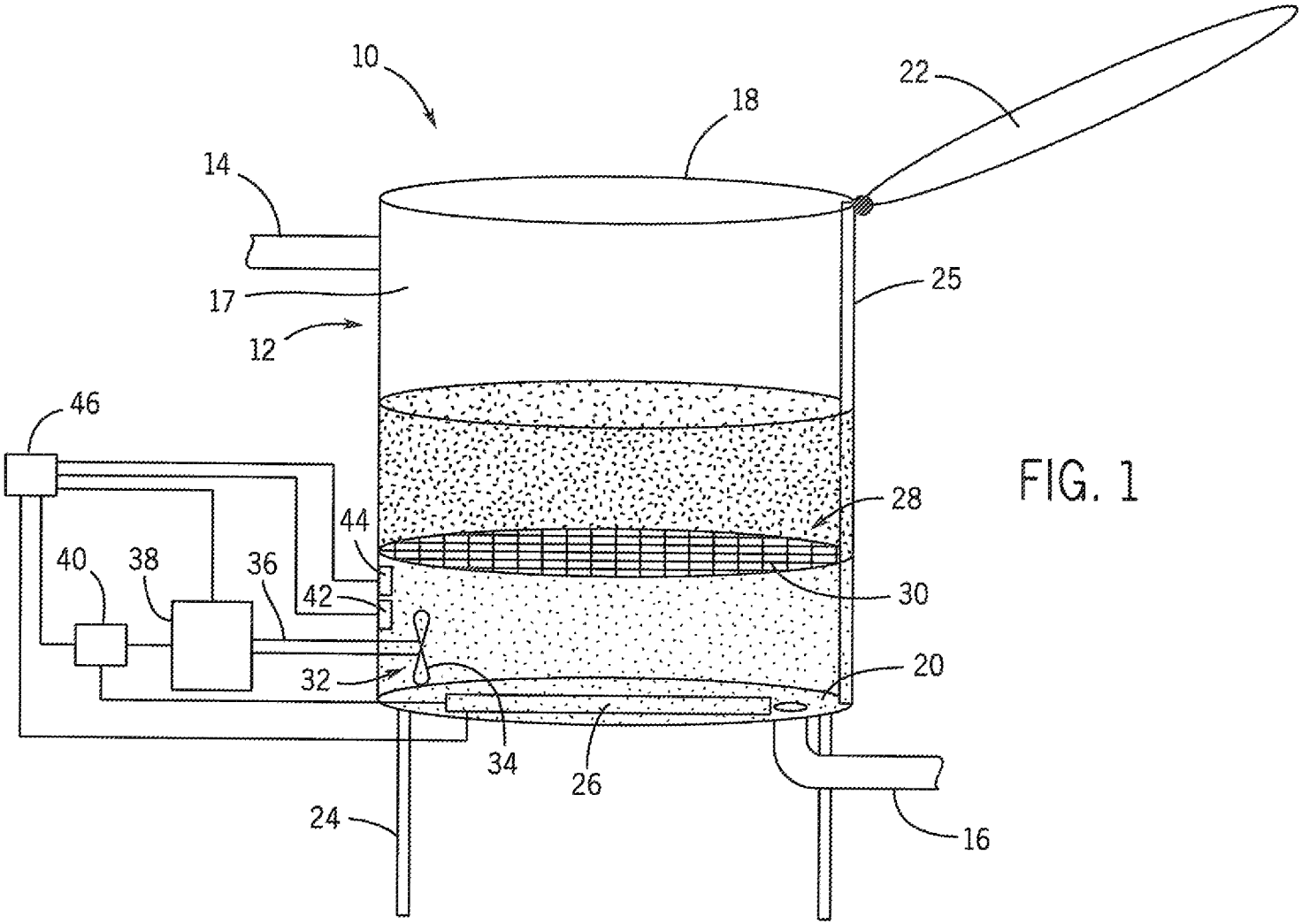
FIG. 1 is a schematic illustration of an exemplary embodiment of a washing tank constructed according to the present disclosure.
Figure 4:
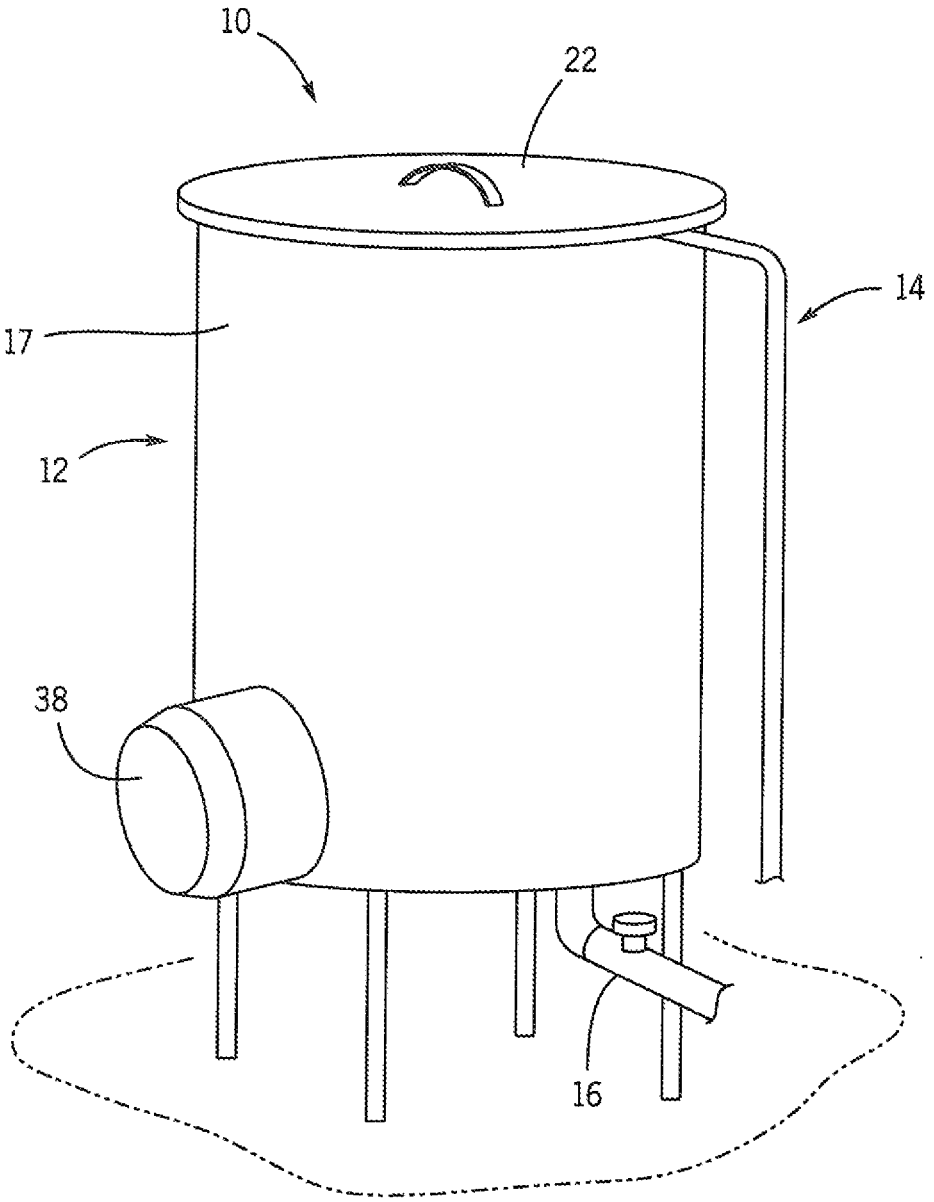
FIG. 4 is a side perspective view of the exemplary embodiment of the tank of FIG. 1.

With reference now to the drawing figures in which like reference numerals designate like parts throughout the disclosure, one exemplary illustrated embodiment of a system or mechanism provided for washing various types of fibrous materials in order to separate the cellulose fraction or component of the fibers from the remainder of the fibrous material, which can include hemicelluloses, lignin and impurities, such as dust and dirt, among others, is illustrated generally at 10 in FIGS. 1 and 4. In the illustrated embodiment, the system or mechanism 10 includes a tank 12 formed of any suitable type of corrosion-resistant material, such as a metal, e.g., a stainless steel, or plastic material. The tank 12 includes an inlet 14 and an outlet 16, with the inlet 14 positioned in a side wall 17 near the upper end 18 of the tank 12 and the outlet 16 disposed in a bottom wall 20 of the tank 12, though the inlet 14 and outlet 16 can be located in other positions on the tank 12.

The tank 12 can have any desired shape, and in the illustrated embodiment is generally cylindrical, with a lid 22 that can be displaced from over the upper end 18 either in whole or in part, or in the illustrated exemplary embodiment, can be pivotally secured to the tank 12 to be able to selectively cover the open upper end 18 an expose the interior of the tank 12. The tank 12 can also be constructed to include a stand 24 engaged with and extending downwardly from the bottom wall 20 of the tank 12. The stand 24 operates to support the tank 12 over a surface, such as a floor, depending upon the size of the tank 12, which can vary in order to hold the desired amount of the fibrous material to be treated.

The tank 12 also includes a measurement scale 25 disposed on the tank 12 that provides a ready indication of the level or volume of materials and washing agents present within the tank 12. The scale 25 can be disposed on the interior or exterior of the tank 12 and in the exemplary embodiment is located on an interior surface of the side wall 17, where the scale 25 can be viewed through the open upper end 18. Alternatively, the scale 25 can be disposed on the exterior of the side all 17, or can positioned at a location on the side wall 17 at a location where it can be viewed through a window or other suitable viewing port (not shown) formed in the side wall 17.

Figure 2:
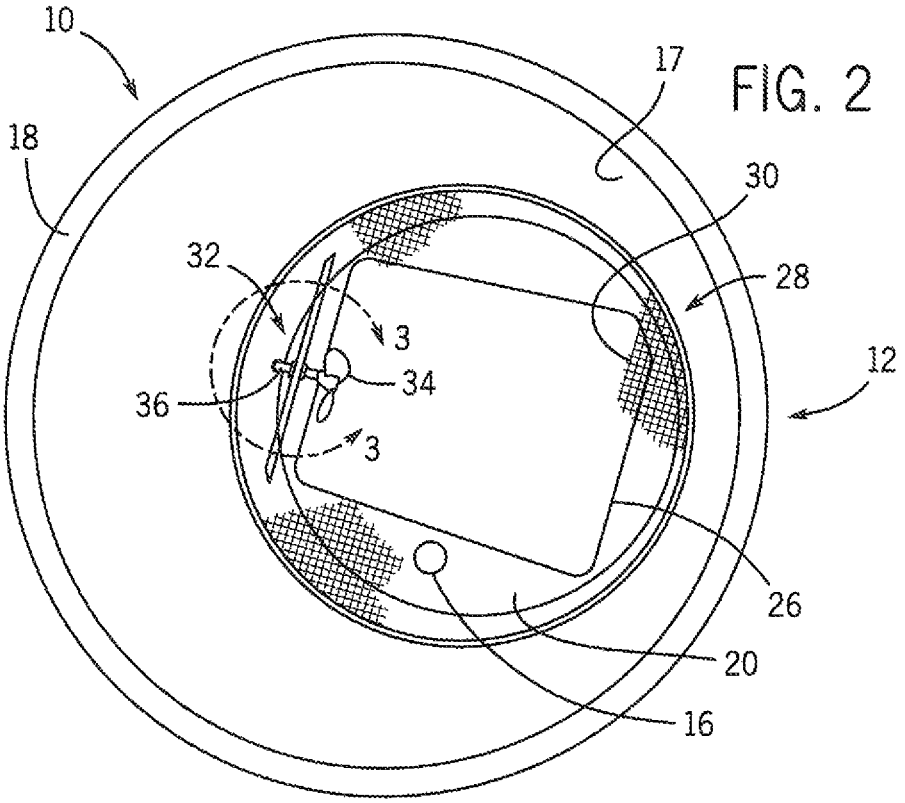
FIG. 2 is a top perspective view of the exemplary embodiment of the tank of FIG. 1.
Figure 3:
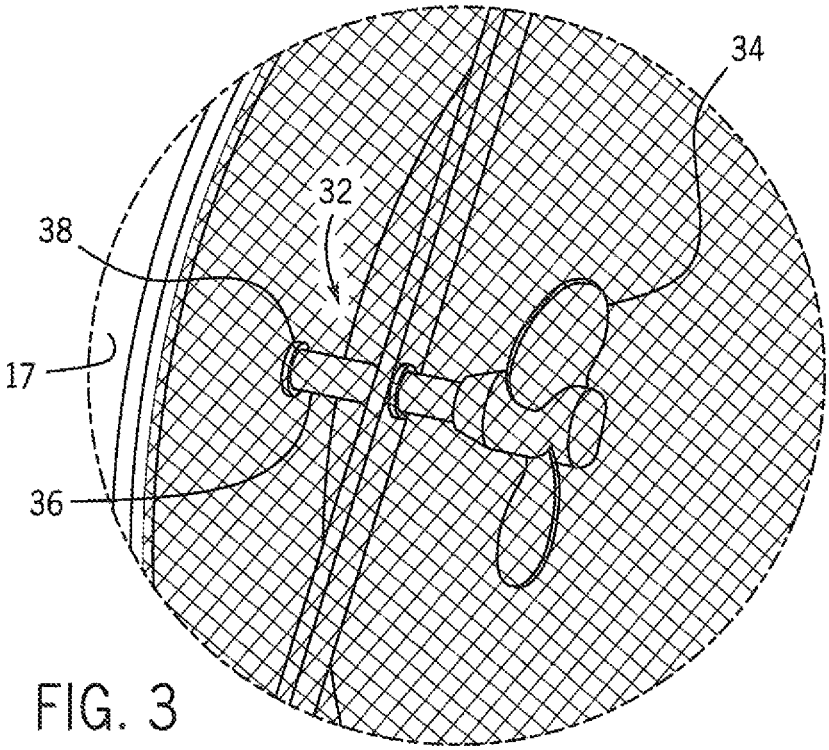
FIG. 3 is a partially broken away perspective view of one exemplary embodiment of the impeller of the tank of FIG. 1.

Referring now to FIGS. 1-3, in the illustrated exemplary embodiment the tank 12 includes a heating element 26 disposed within the tank 12 on the bottom wall 20, though in other embodiments the location of the element 26 can be altered as desired such that the element 26 can be operated to control the temperature of the contents of the tank 12. A screen 28 is also disposed within the tank 12 at a position between the inlet 14 and the outlet 16. The screen 28 is secured in a suitable manner to the side wall 17 of the tank 12, and can be removable for easier cleaning of the interior of the tank 12 when not in use. The screen 28 is formed to enable fluids to pass freely therethrough, such as by having apertures 30 formed in the screen 28, but to retain solid matter over a certain size on top of the screen 28. Thus, the screen 28 functions to enable the fibrous material (not shown) placed in the tank 12 to rest on the screen 28 above the bottom wall 20 to enable efficient washing of the material positioned on the screen 28.

Located in the tank 12 below the screen 28 but above the bottom wall 20 is an agitating device or propeller/impeller 32. The impeller 32 includes a blade 34 disposed within the interior of the tank 10 on a rotating shaft 36. The rotating shaft 36 extends through a suitable watertight but rotatable bearing/sealing member (not shown) disposed within the side wall 17 into operable connection with a motor 38 located adjacent the exterior of the tank 12. The motor 38 operates to rotate the shaft 36 and the blade 34 to agitate the materials held within the tank 12. In the illustrated exemplary embodiment of FIGS. 1-3, the blade 34 of the impeller 32 is oriented vertically in order to rotate in a vertical plane around a horizontal axis of the shaft 36, thereby causing the fluid and washing agent(s) (not shown) present in the tank 12 to move upwardly and/or downwardly, i.e., vertically within the tank 12, enhancing the contact of the fluids and/or washing agent(s) with the fibrous material (not shown) disposed on or above the screen 28.

Further, due to the positioning of the impeller 32 below the level of the screen 28, the blade 34 can rotate freely to agitate the washing fluid/agents within the tank 12 in this manner as a result of the screen 28 limiting the size of any solid material within the tank 12 coming into contact with the blade 34. The orientation of the blade 34 also limits contact of solid material with the blade 34 as a result of the direction of the force imparted to the material in the tank 12 by the impeller 32.

To rotate the blade 34, the motor 38 is connected to a suitable power source 40 also disposed outside of the tank 12 for operation of the motor 38, with the power source 40 and/or motor 38 able to be operated to control the speed of the impeller 32 i.e., rpm increase or decrease, according to the type of fiber positioned in the tank 12. In addition, the power source 40 is also operably connected to the heating element 26 to operate the element 26 such that control of the power source 40 to operate the impeller 32 can also control the operation of the heating element 26.

Still referring to the exemplary embodiment of FIGS. 1-3, also located within the tank 12 beneath the screen 28 are sensors for sensing various operating parameters of the tank 12, such as a pH meter 42 and a thermocouple 44, though the location and type of these sensors can be varied as desired and/or necessary. Each are operably connected to the power source 40 for operation, if necessary, and to a suitable controller 46, such as directly or wirelessly, as is known in the art. The controller 46 is capable of monitoring and/or controlling the operation of the pH meter 42 and the thermocouple 44 in order to determine the conditions present within the tank 12. As a result of this data obtained from the pH meter 42 and the thermocouple 44, the controller 46 can control the operation of the impeller 32 via the motor 38 and power source 40, as well as the heating element 26, as desired, to maintain or alter the conditions within the tank 12 as necessary. The pH meter 42 and thermocouple 44 provide measurements of the pH level and temperature of the materials within the tank 12, such that the controller 46 can be operated to provide conditions within the tank 12 that are optimal for the washing of the fibrous materials placed within the tank 12.

In operation, in either order, the tank 12 is charged with an amount of the washing agents/fluids and the fibrous materials to be washed. Operating conditions within the tank 12 vary depending on various factors, including one or more of the quantity of the fiber positioned within the tank 12, size of fiber positioned within the tank 12, type of pretreatment to be performed within the tank 10, type of washing agent/chemicals to be utilized, water activities temperature, the pH of the water, and/or the particular usage of biocomposite end products to be formed using the biocomposite material incorporating the fiber treated in the tank 12, among others. Some exemplary embodiments of these types of treatments that can be performed within the tank 12 of this disclosure are found in co-owned and co-pending U.S. Non-Provisional patent application Ser. No. 14/087,326, filed on Nov. 22, 2013, the entirety of which is expressly incorporated by reference herein.

In one exemplary embodiment of the method of operation of the tank 12, the selected washing agents are introduced through the inlet 14, while the fibrous material is placed within the tank 12 through the open upper end 18. The lid 22 is subsequently closed over the tank 12 and the motor 38 connected to the impeller 32 is started, thereby causing the washing agent to move up and down within the tank 12 and through the screen 28. This movement optimizes the contact of the washing agents/fluids with the fibrous materials disposed within the tank 12 and/or on the screen 28 to cause the maximum amount of hemicellulose, lignin, and impurities to be separated from the cellulose. Further, using the data obtained by the pH meter 42 and the thermocouple 44, the conditions within the tank 12 can be optimized in a known manner during operation for separation of the cellulose using the heating element 26 and/or by adding, removing or altering the types and/or amounts of washing agents/fluids present within the tank 12.

The hemicellulose, lignin, and impurities that are separated from the cellulose and fall through the screen 28 to the bottom of the tank 12, while the cellulose fibers remains on the screen 28. Once the washing process is complete, the hemicellulose, lignin and impurities can be drained out of the tank 12 along with the washing agent through the outlet 16. The cleaned and washed cellulose remaining on the screen 28 can then be taken out via the open end 18 once the lid 22 is removed and dried for later use in forming biocomposite materials. After being drained from the tank 12, the washing agent removed through the outlet 16 can be separated and/filtered from the hemicelluloses, lignin and impurities for re-use in the tank 12. By utilizing this system 10 to separate and clean the cellulose fibers from the remainder of the fibrous material fractions and impurities, the cellulose fibers are maintained in a highly undamaged state, maximizing the enhancements provided by the inclusion of the cellulose fibers in a biocomposite material, such as strength enhancements.

In one example, Saskatchewan gown oil seed flax straw placed within the tank 12 as the fibrous material and treated in a manner disclosed in U.S. Non-Provisional patent application Ser. No. 14/087,326, the entirety of which is expressly incorporated by reference herein, has almost 50-68% w/w cellulose content with the remainder being hemicellulose and lignin. After suitable pretreatment of the fiber, in similar washing conditions (same water temperature, pH, same fiber, washing time etc.), it is possible to extract up to 60% w/w of clean cellulose in this developed system using the tank 12, as compared to 30 to 40% w/w of cellulose along with a portion of lignin and hemicellulose in currently used, prior art normal washing practices. Further, this washing system 10 and method is developed not only for research and development, but also for industrial usage. The current developed system 10 also reduces the water usage 30-40% and can reduce by half the washing time compared to prior art currently used, normal washing practices and systems. This system 10 also allows the capture the black liquor, which is a mixture of hemicellulose, lignin, any residual chemicals/washing agent and other impurities in an effective manner to reprocess, dispose and/or extract these biopolymers for different applications.

In alternative embodiments for the mechanism/system 10, in addition to or as a replacement for the impeller 32, the agitating device can be formed from jets of pressurized air (not shown) can be directed from suitable nozzles (not shown) disposed on the bottom wall 20 of the tank 12 upwardly towards the screen 28 to agitate the washing agent(s) and fibrous material. In another alternative embodiment, either in conjunction with or separately from the impeller 32, the stand 24 for the tank 12 can operate as an agitating device, e.g., in the manner of a shaker table (not shown), to move the entire tank 12 in order to agitate the contents of the tank 12.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. An apparatus for washing fibrous materials to remove cellulose from other components of the fibrous material, the apparatus comprising:

a) a tank having a bottom wall and at least one side wall to define an open upper end for the tank;

b) a screen positioned within the tank over the bottom wall;

c) an agitating device disposed within the tank capable of moving a fluid within the tank in a vertical direction;

d) a potentiometric (pH) sensor communicating with an interior of the tank, the pH meter sensing a pH level of the fluid within the tank; and e) a controller operatively connected to the pH sensor and the agitating device, the controller controlling operation of the agitating device in response to the pH level sensed by pH sensor.

2. The apparatus of claim 1 further comprising a heating element disposed within the tank.

3. The apparatus of claim 2 wherein the heating element is disposed between the screen and the bottom wall.

4. The apparatus of claim 1 wherein the agitating device comprises:

a) a rotating shaft extending through the at least one side wall into the tank; and b) a blade affixed to the rotating shaft within the tank.

5. The apparatus of claim 4 wherein the agitating device is disposed at least partially between the screen and the bottom wall.

6. The apparatus of claim 4 further comprising a motor operably connected to the rotating shaft opposite the blade.

7. The apparatus of claim 6 wherein the controller is operably connected to the motor to control the operation of the motor and rotation of the shaft.

8. The apparatus of claim 4 wherein the blade is oriented in a vertical plane.

9. The apparatus of claim 1 further comprising:

a) at least one sensor operably connected to the tank to sense an operating parameter of the tank; and b) the controller operably connected to the at least one sensor to receive data on the operating parameter of the tank from the at least one sensor.

10. The apparatus of claim 9 wherein the controller controls operation of the agitating device in response to the data regarding the operating parameter obtained from the at least one sensor and the pH sensor.

11. The apparatus of claim 10 where in the sensor is a temperature sensor.

12. The apparatus of claim 1 wherein the screen includes apertures extending therethrough, the apertures sized to enable hemicellulose, lignin and impurities to pass through the apertures, while retaining cellulose fibers on the screen.

13. The apparatus of claim 12 further comprising a fluid outlet in the bottom wall.

14. A method for washing fibrous materials to separate cellulose fibers from other components of the fibrous material, the method comprising:

a) placing an amount of the fibrous material and an amount of a washing agent within the apparatus of claim 1;

b) operating the agitating device to move the washing agent vertically into contact with the fibrous material; and c) allowing the hemicellulose, lignin and other impurities to pass through the screen while retaining the cellulose fibers on the screen.

15. The method of claim 14 wherein the apparatus further includes at least one sensor disposed on the tank for sending data on an operating parameter of the tank and a controller operably connected to the at least one sensor and the agitating device, and wherein the method further comprises the steps of:

a) receiving data in the controller from the at least one sensor; and b) altering the operation of the agitating device in response to the data from the at least one sensor.

16. The method of claim 15 further comprising the steps of:

a) draining the washing agent, hemicellulose, lignin and impurities from the tank;

b) filtering the hemicellulose, lignin and impurities from the washing agent; and c) replacing the washing agent in the tank with another amount of the fibrous material.

17. The method of claim 16 further comprising the step of extracting the hemicellulose and lignin from the impurities.

18. The method of claim 16 further comprising the steps of:

a) removing the cellulose from the tank after draining the tank; and b) forming a biocomposite material with the cellulose fibers.

* * * * *